US006647857B1

(12) United States Patent
Newkirk

(10) Patent No.: US 6,647,857 B1
(45) Date of Patent: Nov. 18, 2003

(54) BULLET PROTECTIVE SUNVISOR

(76) Inventor: Kirk H. Newkirk, 38 Outrigger Ct., Long Beach, CA (US) 90803

( * ) Notice: Subject to any disclaimer, the term of this patent is extended or adjusted under 35 U.S.C. 154(b) by 0 days.

(21) Appl. No.: 10/185,878

(22) Filed: Jun. 28, 2002

(51) Int. Cl.[7] ..... F41H 5/013; F41H 5/08; F41H 5/26

(52) U.S. Cl. ..... 89/36.08; 89/36.02; 296/97.3; 296/97.8

(58) Field of Search ..... 89/36.02, 36.08, 89/36.14; 296/96.18, 97.3, 97.1, 97.6, 97.8

(56) References Cited

U.S. PATENT DOCUMENTS

| | | | | |
|---|---|---|---|---|
| 1,632,360 A | | 6/1927 | Wilson | |
| 1,928,306 A | | 9/1933 | Brennan | |
| 3,855,898 A | | 12/1974 | McDonald | |
| 4,280,730 A | | 7/1981 | Turner | |
| 4,384,740 A | * | 5/1983 | Marrotta | |
| 4,643,477 A | | 2/1987 | Kovatch | |
| 5,307,725 A | | 5/1994 | Desmond et al. | |
| 5,470,122 A | * | 11/1995 | Feng | 296/97.6 |
| 5,487,323 A | | 1/1996 | Madden, Jr. | |
| 5,703,316 A | | 12/1997 | Madden, Jr. | |
| 6,302,010 B1 | * | 10/2001 | Holler | 89/36.08 |

FOREIGN PATENT DOCUMENTS

GB 2 052 695 A * 1/1981

* cited by examiner

*Primary Examiner*—Stephen M. Johnson
(74) *Attorney, Agent, or Firm*—Fulwider Patton Lee & Utecht LLP

(57) ABSTRACT

The invention is directed to a foldable bullet protective shield for mounting to the backside of a sunvisor of a motor vehicle, said shield having an upper portion and a lower portion, each portion being formed of at least one plate of bullet protective material, the top edge of the lower portion being connected to the bottom edge of the upper portion via a hinge, at least one portion including a viewing window to provide a driveable view therethrough. Optionally, at least one of the portions may be encased in a shell of material such as nylon. Alternatively, the bullet protective shield can be incorporated into a shield assembly including a rotatable and swingable pivot arm connected to a mountable bracket.

9 Claims, 4 Drawing Sheets

BULLET PROTECTIVE SUNVISOR

BACKGROUND OF THE INVENTION

1. Field of the Invention

This invention relates to the field of protective shields for motor vehicles and in particular to sunvisors designed to provide protection from firearms.

2. Description of the Related Art

A variety of shield devices have been proposed to protect motor vehicle occupants from gunfire including from frontal, rear and flank attack. Armored limousines, for example, are well known in the art. Many such limousines include expensive heavy duty side armor and bullet proof glass to block entry into the passenger compartment of bullets or other projectiles fired at the occupants. Other attempted solutions have included, for example, the fixation of bulletproof glass panels adjacent to the factory installed standard glazing.

Lighter duty and less expensive solutions than the utilization of an armored limousine have also been proposed. U.S. Pat. No. 4,643,477 to Kovatch discloses a sheet of transparent armor that may be removably slid into position behind a standard windshield along rollers captured by tracks mounted to window posts thereby protecting the driver and other occupants of the vehicle. The '477 patent attempts to solve the problems of cleaning the opposed facing transparent surfaces presented by fixed add-on armor of the prior art by disclosing that the removable armor be pivoted about the rollers and away from the windshield.

In U.S. Pat. No. 5,703,316 to Madden, Jr., it was proposed that a foldable bullet resistant curtain of material is removably secured to the underside of a trunk lid of an automobile and is deployed when the trunk is opened to resist bullets fired from behind the vehicle. The curtain, however, does not protect the occupants from frontal or side attack.

Others have proposed cumbersome and unwieldy protective shields that, when deployed, render the vehicle unsafe to drive. For example, U.S. Pat. No. 1,632,360 to Wilson is directed to an armored truck wherein, among other armored features proposed to enclose the cab from attack, is a shutter of armor plate hingedly mounted above the windshield and held in a raised horizontal position by a hook adapted to engage the edge of the shutter. The hook is disengaged from the edge of the shutter by operator actuation of a cable through a pulley allowing the shutter to fall to a vertical position behind the windshield. However, when the shutter is deployed into protective position, it also blocks the operator's view rendering the armored truck unsafe to drive. The truck is equipped, however, with gunsight openings for self defense and signal rockets to draw attention and assistance from others.

What has been absent in the protective arts is a convenient, easily installable, readily deployable and undeployable, bullet protective shield for protecting vehicle occupants from gunfire while at the same time still allowing for the vehicle to be safely driven by the vehicle's driver.

SUMMARY OF THE INVENTION

The subject invention is directed to a bullet protective shield for mounting to a sunvisor of a motor vehicle, the sunvisor having a frontside and a backside when deployed, said shield comprising an upper portion and a lower portion each portion being formed of a plate of bullet protective material. Optionally, at least one of the plates may be encased in a shell of material such as nylon. The upper shield portion having a generally rectangular configuration comprising a front surface, a back surface, top, bottom, and side edges. The lower portion having a similar generally rectangular configuration and including a front surface, a back surface, top, bottom, and side edges. The top edge of said lower portion is connected to the bottom edge of the upper portion via a hinge such that the back surface of the lower portion may be folded toward or away from the back surface of the upper portion. A fastening means is provided for maintaining the protective shield in the folded position. A window of bullet protective material is provided within at least one of said portions of the shield whereby the vehicle may be safely driven when the shield is deployed. Clip means are provided along the top edge of the upper portion of the shield for attaching the shield to the vehicle's sunvisor. Alternatively, the bullet protective shield can be incorporated into a shield assembly including a rotatable and swingable pivot arm connected to a mountable bracket, which is installed in place of the vehicle's standard sunvisor.

These and other features and advantages of the present invention will become apparent from the following detailed description which taken in conjunction with the accompanying drawings, further describes and illustrates by way of example the principles of the invention.

DETAILED DESCRIPTION OF THE PREFERRED EMBODIMENT

Figure 1:
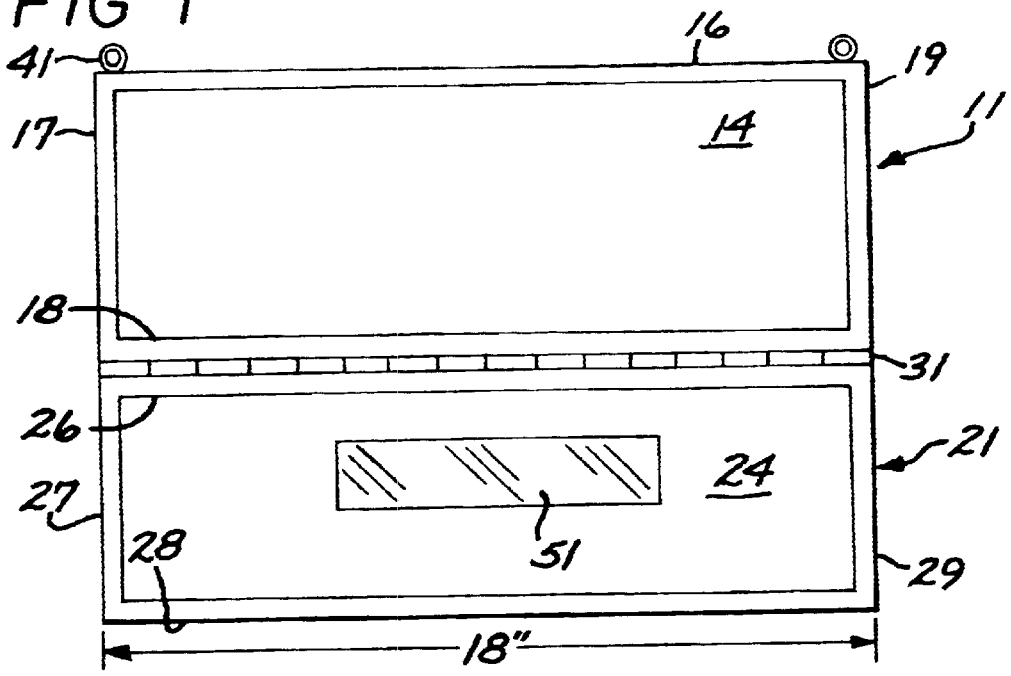
FIG. 1 is a rear view of the present invention in its deployed or protective position.
Figure 2:
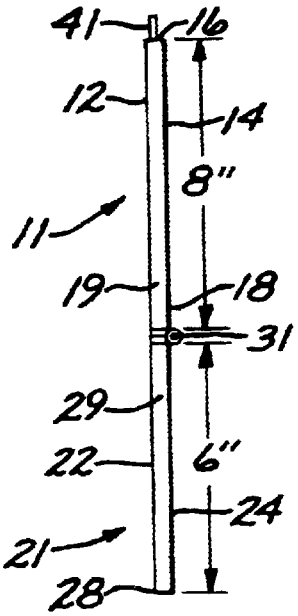
FIG. 2 is a side view of the present invention in its deployed or protective position.

Referring to FIG. 1 and FIG. 2, the bullet protective shield includes an upper portion 11 and a lower portion 21, when the shield is viewed in the deployed position. Each of the portions includes a plate of bullet resistant material encased with a shell of material such as nylon or the like. The upper portion of the shield is generally rectangular in shape and includes a front surface 12, a back surface 14, a top edge 16, a bottom edge 18, and side edges 17 and 19.

The lower portion 21 is also generally rectangular in shape and includes a front surface 22, a back surface 24, top and bottom edges 26 and 28, respectively, and side edges 27 and 29. The top edge 26 of the lower portion is connected to the bottom edge 18 of the upper portion 11 via a hinge 31. The hinged connection allows the lower portion to pivot both toward and away from the back surface 14 of the upper portion. The hinge may be exposed, or alternatively, may be encased separately by additional encasing material or may be included within the shell of one of the portions.

Figure 7:
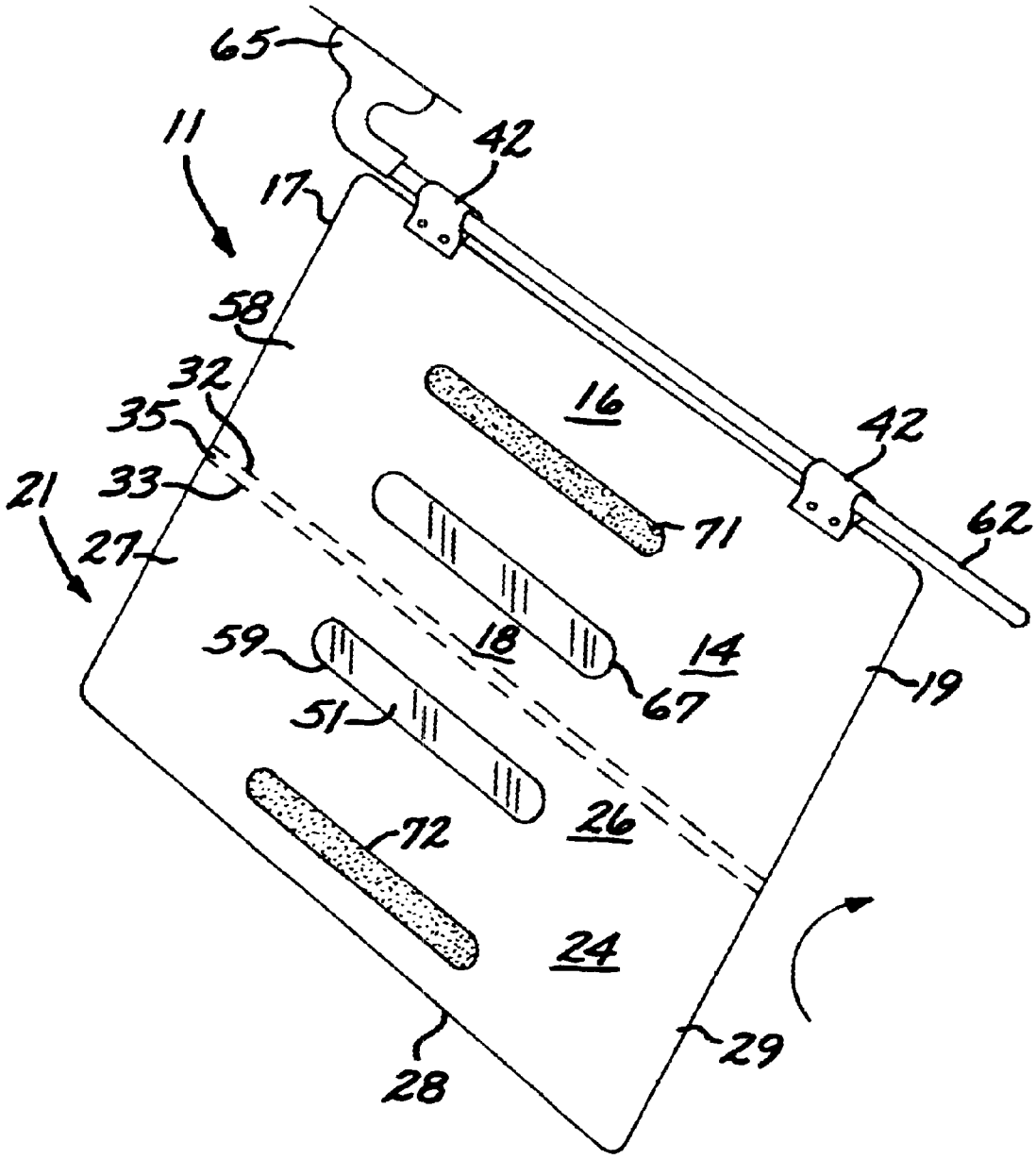
FIG. 7 is a perspective view of an alternate embodiment of the present invention.

In a preferred embodiment, the hinge 31 is spring loaded and biased as is known in the art to urge and hold the lower portion in a folded position against the upper portion, the back surface 24 of the lower portion in facing opposition to the back surface 14 of the upper portion. Other means may be provided for releasably securing back surface 24 of the lower portion 21 to the back surface 14 of upper portion 11 as shown in FIG. 7. Means for securing the lower portion to the upper portion in a folded position include, by way of example, fasteners such as hook and loop fasteners, buttons, mating snaps, laches, or the like as known in the art.

In a preferred embodiment, the bullet resistant plate is preferably about 0.25 inches thick and is preferably rated at least level three +by the National Institute of Justice. The plate can be made of Kevlar® by DuPont or may also be formed from aramid fabric or other bullet protective materials as are known in the art. The plate may be of a single piece construction or it may be a composite or layered structure. It is to be understood that a single piece of foldable bullet protective material may be utilized in the present invention, a fold comprising the hinge, the upper and lower portions of the shield being formed on opposite sides of the hinge.

The lower portion 21 also includes a viewing window 51 of bullet protective material enabling an occupant to through said window when the upper and lower portions are fully deployed in the open protective position. This provision of a window within the shield allows for the vehicle to be driven when the shield is fully deployed. In a preferred embodiment, the window is clear and is formed of bullet protective plastic material such as polycarbonate or the like and is equal in thickness to the plate, namely at least about 0.25 inches thick.

Referring to FIG. 2, the shield of the present embodiment is shown deployed in an open protective position. The shield further includes at least one clip 41 connected to the top edge16 for mounting the upper portion 11 to a standard vehicle sunvisor (not shown), the front surface 12 of the upper portion facing and abutting the rear surface of the sunvisor, the forward surface of the sunvisor facing the windshield when deployed to block the sun directed therethrough. The clip may be fixedly attached to the sunvisor with fasteners such as screws, rivets, or other fasteners known in the art and may, for example, slip over the sunvisor to hold the shield to the sunvisor. The clip may alternatively be removeably attached to the sunvisor and the upper portion by way, for example, of a resilient clip which may be inserted over the top and extend at least part way down the frontside of the sunvisor and the upper portion to hold the shield to the backside of the sunvisor.

Figure 5:
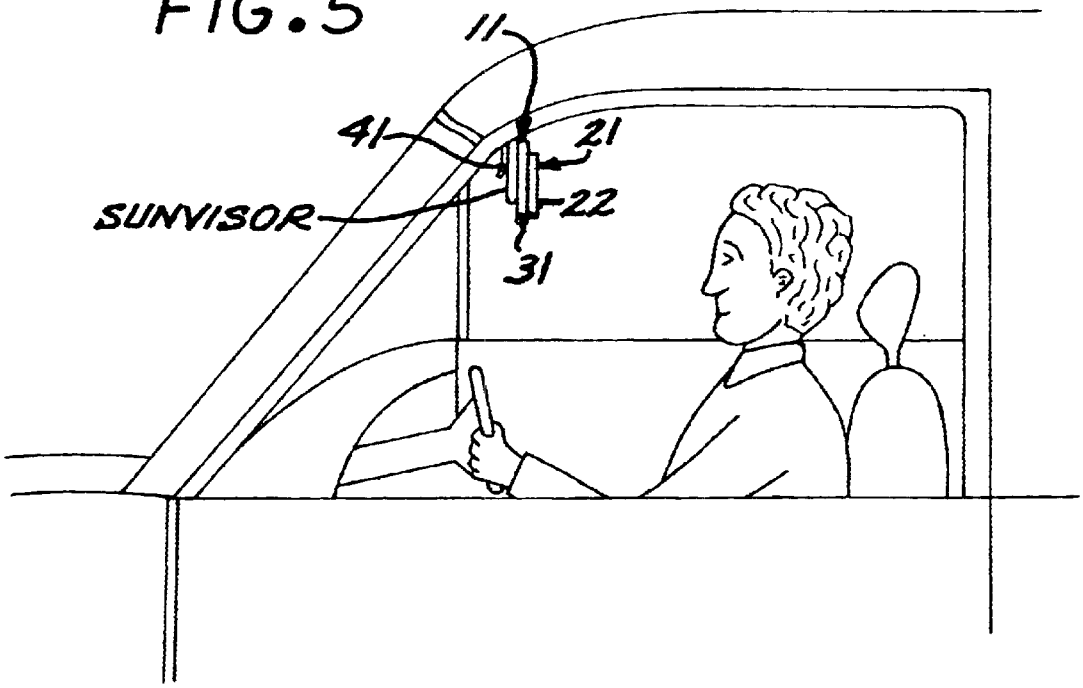
FIG. 5 is a side view of the present invention in a stored state in a motor vehicle.

The bullet protective shield is fully deployed when in the open position extending vertically between an occupant of the vehicle and the inner surface of the vehicle windshield. Optionally, the shield and sunvisor may be swung in standard pivot fashion toward a side window to block bullets or projectiles directed at the vehicle occupant from the side of the vehicle. When not deployed in a protective mode, the shield is stored on the vehicle sunvisor. The lower portion 21 is folded so it is adjacent to upper portion 11 as shown in FIG. 5. When the sunvisor is not in use, the shield will be held between the retracted sunvisor and the vehicle roof. When the sunvisor is in use for its intended function of shielding the occupants eyes from the sun, the lower portion stays folded upon the upper portion thereby providing normal visibility.

In a preferred embodiment, hinge 31 is a spring loaded hinge of the type known to those skilled in the art. The spring loaded hinge acts to hold the upper and lower plates together so that top edge 26 of lower portion 21 and bottom edge 18 of the upper portion 11 are in a mating abutment with each other. When deployed, the respective front and rear surfaces of said plates are essentially co-planar as shown in FIG. 2. When the shield is folded into a storage position the spring loaded hinge acts to keep the lower portion folded up against the upper portion. The hinge may also be of a lockable variety wherein the upper and lower portions may be releaseably held in position relative to each other, such as in a fully deployed state.

Figure 3A:
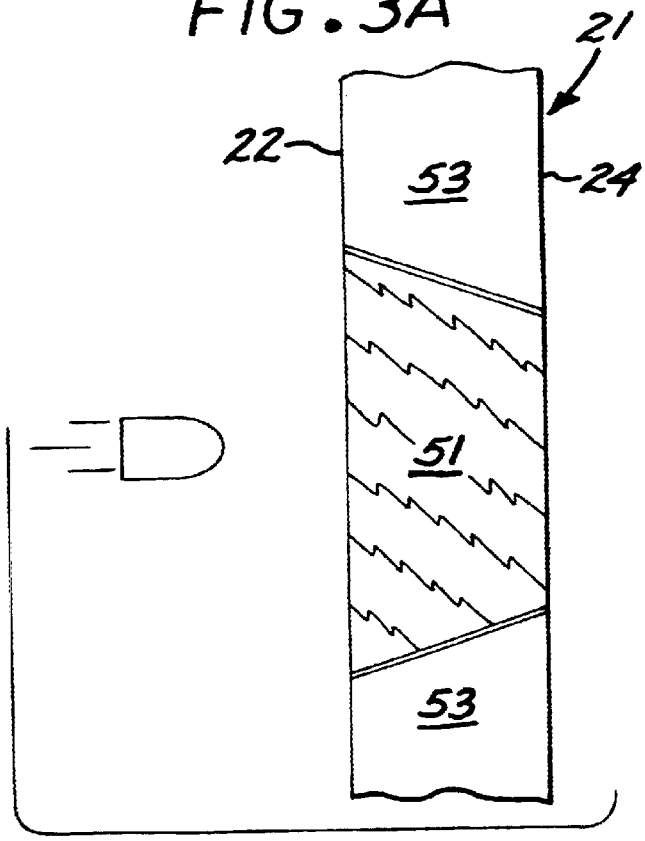
FIG. 3A is cross sectional view including a wedge fit window of the present invention.

Referring to FIG. 3A, window 51 of bullet protective material is provided in the lower portion 21, for example, as a press fit insert wedged into a beveled opening formed in the plate 53. To inhibit the insert from being dislodged from the shield and toward the occupant if struck by a bullet, the opening should be formed larger on the front surface 22 with the opening tapering narrower to the back surface 24.

Figure 3B:
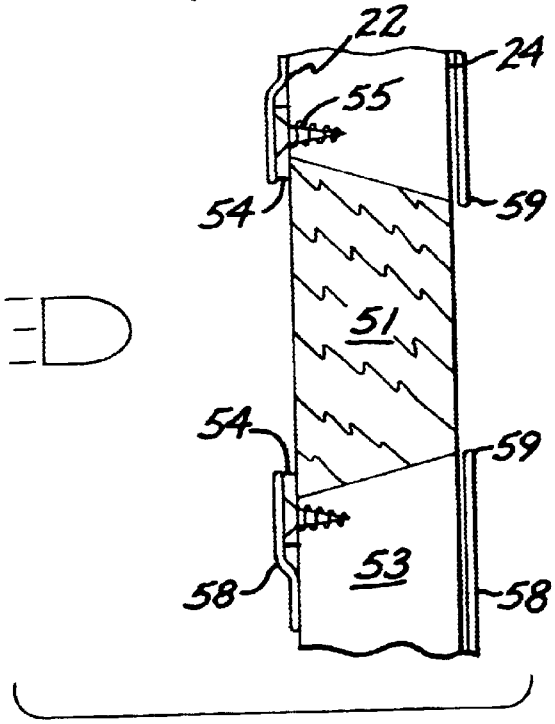
FIG. 3B is cross sectional view including a wedge fit window and shell apertures of the present invention.

In FIG. 3B, the wedge is additionally secured to the lower portion 21 by way of a frame 54 around its perimeter and attached to the front surface 22 by fasteners 55. Adhesive may optionally or additionally be employed to secure the window to the plate 53. The present embodiment includes a shell 58 of material encasing the plate of the lower portion. The shell of the lower portion of the present embodiment provides opposing aligned apertures adjacent the window 51, each aperture being formed by an aperture edge 59 of the shell to allow viewing through the window.

Figure 3C:
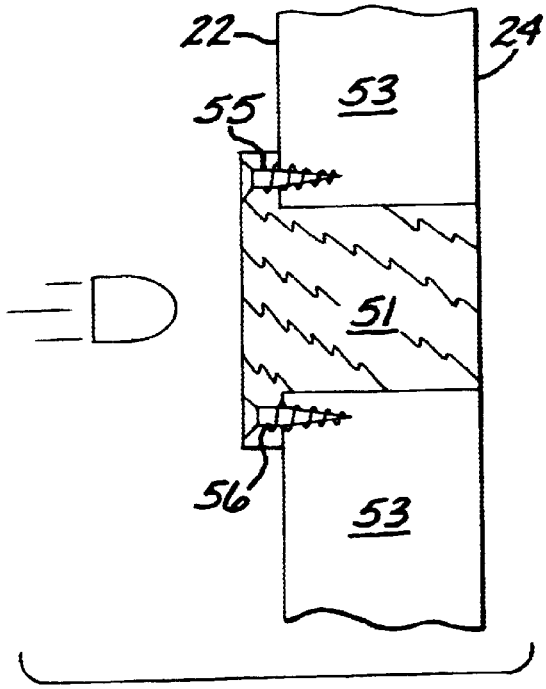
FIG. 3C is cross sectional view including a window of the present invention with a flange.

Alternatively, as shown in FIG. 3C, an opening perpendicular to the front and back surfaces of the lower portion, 22 and 24 respectively, may be formed in the plate 53, the window being formed with parallel sides so as to fit into the opening and having a flange. 56 exceeding the dimensions of the opening and providing an interference stop on insertion into the opening at the front surface of the lower portion, the window being additionally secureable to the plate by way of adhesive and/or fasteners 55, if desired. Optionally, the plate may be recessed to accommodate the flange providing a flush mount.

Although FIGS. 3A–3C are described as having the window 51 in the lower portion 21, the window may alternatively be formed in the upper portion 11 of the shield positioned below the bottom of the sunvisor to provide an unrestricted view therethrough. For example, the embodiment shown in FIG. 2 includes an upper portion with a side edge 19 being 8 inches in length. Should the sunvisor not extend to block a window positioned at or near the bottom edge 18 of the upper portion, such a window may be useful to an occupant, especially a tall driver to provide an adequate driveable view while the shield is fully deployed. Optionally, windows may be configured in both portions to provide alternative viewing positions. Further optionally, windows may be provided in both portions so that when the shield is in the closed position, the windows are aligned to provide unrestricted viewing through both portions. If shell material is used, aligning apertures may also be configured for each window.

Figure 4:
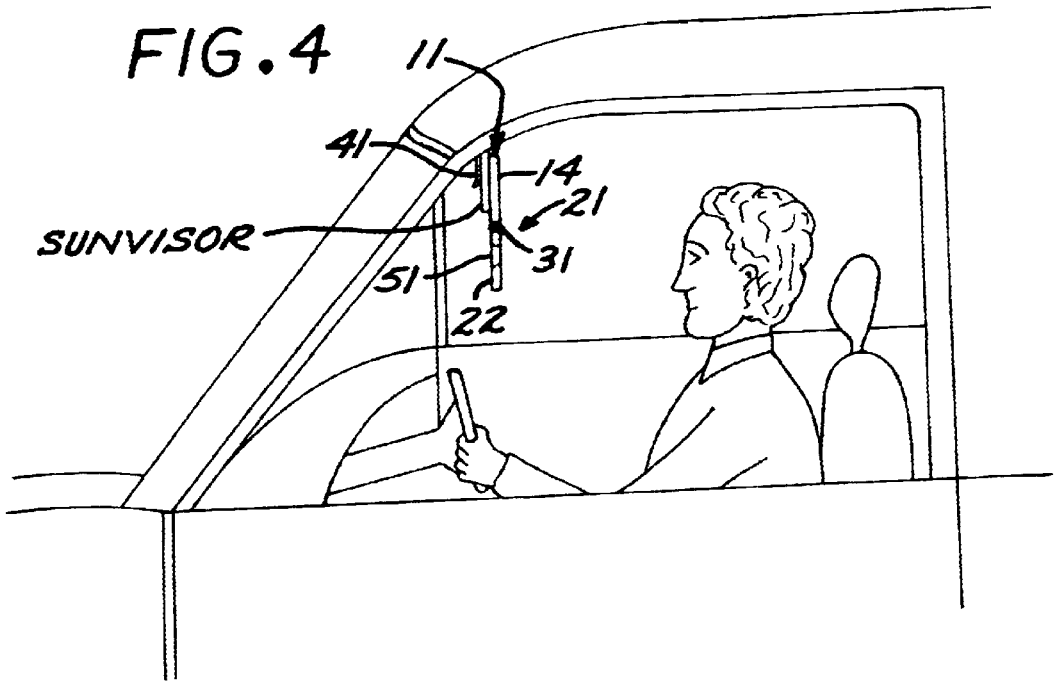
FIG. 4 is a side view of the present invention deployed in a motor vehicle.

FIG. 4 is a side view of the present embodiment deployed in a motor vehicle. The deployed shield shows the upper portion 11 attached to the backside of the sunvisor by clip 41 slipped thereover. The lower portion 21 is folded down via the hinge 31 to block incoming bullets or other projectiles. In this position, the back surface 14 of the upper portion and the back surface 24 of the lower portion are essentially co-planar and are suspended vertically between the driver and the windshield, the front surface 22 of the lower portion facing the windshield. A window 51 is included in the lower portion providing the driver with a forward view so that the vehicle may be driven while the shield is deployed.

FIG. 5 is a side view of the present embodiment in a stored state in a motor vehicle. In this embodiment the front surface 22 of the lower portion 21 is facing the driver. When neither the sunvisor nor the shield is needed the sunvisor along with the folded shield may be further stored by swinging it upwardly toward the driver adjacent the vehicle roof as is known with standard sunvisors.

Figure 6:
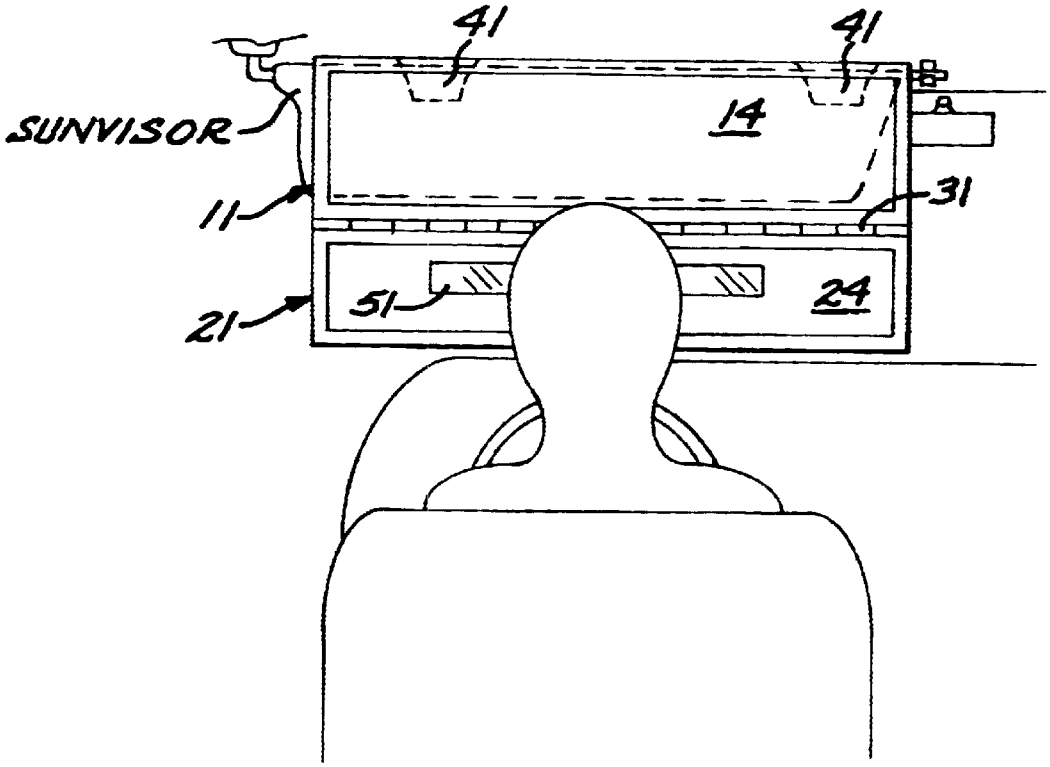
FIG. 6 is a rear view of the present invention deployed in a motor vehicle.

FIG. 6 is a rear view of the present embodiment deployed in a motor vehicle. The deployed shield shows the upper portion 11 attached to the backside of the sunvisor by clips 41 slipped thereover. The lower portion 21 is folded down via the hinge 31. In this position, the upper and lower portions are suspended in an open deployed condition between the driver and the windshield to block bullets or other projectiles directed at driver through the front of the windshield. A window 51 is included in the lower portion providing a driveable view.

Alternatively, the bullet protective shield can be formed or constructed as an assembly incorporating a vehicle sunvisor rather than as a peripheral device mounted to and abutting a standard vehicle sunvisor. Instead of clips, as shown in FIGS. 1 and 2, which fasten or hold the shield to an existing sunvisor, the upper portion of the shield of the present embodiment displaces the standard sunvisor panel and is directly attached to a standard sunvisor pivot arm by way of at least one clasp. Such an assembly may be provided, for example, in the aftermarket or may, for example, be factory installed on vehicles such as police, military, and other vehicles outfitted with security features.

Such an embodiment is illustrated in FIG. 7. In this embodiment, the combination sunvisor-protective shield assembly includes a spring loaded rotatable pivot arm 62 of the type typically used on a motor vehicle sunvisor and known to those skilled in the art. The pivot arm, including a longitudinal pivot arm axis, is connected to a pivot bracket 65 and together with the bracket is configured to rotate the shield as desired about the axis upwardly to a stored position adjacent the underside of the vehicle roof and downwardly to a deployed position between a vehicle occupant and the windshield or a side window as desired. The pivot bracket is configured for mounting the assembly to the underside of the vehicle roof adjacent an upper comer of the windshield on the driver's or front passenger's side of vehicle, and for swinging the arm with attached shield as desired for deployment between the occupant and the windshield or a side window of a vehicle to block bullets or other projectiles. The pivot arm and bracket are configured to operate as is commonly understood in the sunvisor art. The shield may be advantageously deployed in such fashion at the option of the occupant to block sunlight and/or incoming bullets or projectiles. When the shield is deployed in front of the windshield on the driver's side, the viewing window 51 provides a driveable view therethrough.

The top edge 16 of the upper portion 11 of the present embodiment is rigidly and grippingly connected to the pivot arm by a pair of gripping clasps 42. The clasps grip the arm so that the upper portion turns with the rotatable pivot arm eliminating slip therebetween. The clasps of the present embodiment are fastened through the shell 58 and the plate by way of screws, rivets, or other fasteners known in the art, to rigidly connect the upper portion to the pivot arm. Alternatively, a single elongated clasp or additional clasps may be provided as desired.

Referring to FIG. 7, the bullet protective shield of the present embodiment includes an upper portion 11 and a lower portion 21, when the shield is viewed in the deployed position. Each of the portions includes a plate of bullet resistant material encased with a shell of material such as nylon or the like. The upper portion of the shield is generally rectangular in shape and includes a front surface (not shown), a back surface 14, a top edge 16, a bottom edge 18, and side edges 17 and 19. The lower portion 21 is also generally rectangular in shape and includes a front surface (not shown), a back surface 24, top and bottom edges 26 and 28 respectively, and side edges 27 and 29.

In the present embodiment, the shell 58 is a single envelope encasing both plates and separating the upper portion 11 from the lower portion 21 by a first seam 32 joining the front surface (not shown) of the upper portion to the back surface 14. A second seam 33 is provided adjacent and beneath the first seam. said second seam joining the front surface (not shown) of the lower portion to the back surface 24, a hinge 35 being formed by the material between said first and said second seam. Alternatively, a single seam may be provided forming the hinge.

The lower portion 21 includes a viewing window 51 therein. A first window aperture is formed in the shell 58 by a first aperture edge 59 in the back surface 24 of the lower portion. An opposing aperture and edge (not shown) is formed in the front surface (not shown) of the lower portion to provide for unobstructed viewing through the window.

The lower portion 21 may be folded to a closed position and fastened in place to the upper portion 11 by a hook patch 71 affixed to the back surface 14 of the upper portion and a loop patch 72 affixed to the back surface 24 of the lower portion. Alternative fasteners such as, for example, buttons, latches, or mating snaps may be employed to removeably secure the lower portion to the upper portion as is known in the art.

With continued reference to FIG. 7, a second window 67, constructed similarly to the window 51 in the lower portion, may be optionally provided in the upper portion 11. Both windows 51 and 67 may be aligned to provide unrestricted viewing through both positions when the shield is the closed position. It will be appreciated that when the shield is an open position, the dual window configuration may provide alternative viewing positions and that other suitable window locations may be constructed into the shield including offset window positions.

Having described only typical forms and applications of the present invention, it is not intended that the invention be limited to the specific details herein set forth. While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A bullet protective shield assembly for a motor vehicle having a roof with an underside, a windshield with an upper driver's corner and an upper passenger corner, the assembly comprising:

a bullet protective shield including all upper portion and a lower portion, both portions comprised of bullet protective material, the upper portion having a front surface, a back surface, a top edge, and a bottom edge, the lower portion having a front surface, a back surface, a top edge, and a bottom edge, the top edge of the lower portion connected to the bottom edge of the upper portion via a hinge, the lower portion being hingeably moveable toward, away from, and releasably securable to the back surface of the upper portion, at least one portion including a viewing window providing a view therethrough;

a pivot arm for rotating the shield toward and away from the underside of the roof, the arm including a pivot arm axis:

at least one clasp grippingly and rigidly connecting the top edge of the upper portion to the pivot arm; and a pivot bracket connected to the pivot arm, the bracket being mountable to the underside of the roof adjacent an upper corner of the windshield and configured to rotate the shield about the pivot arm axis to a stored position adjacent the underside of the roof and to a deployed position, the bracket further configured for swinging the arm with attached shield to a position between a side window and the occupant.

2. A bullet protective shield assembly for a motor vehicle having a roof with an underside, a windshield with an upper driver's corner and an upper passenger comer, the assembly comprising:

a bullet protective shield including an upper portion and a lower portion, each portion including at least one plate of bullet protective material, the upper portion having a front surface, a back surface, a top edge, and a bottom edge, the lower portion having a front surface, a back surface, a top edge, and a bottom edge, the top edge of the lower portion connected to the bottom edge of the upper portion via a hinge, the lower portion being hingeably moveable toward, away from, and releasably securable to the back surface of the upper portion, at least one portion including a viewing window providing a view therethrough;

a pivot arm for rotating the shield toward and away from the underside of the roof, the arm including a pivot arm axis;

at least one clasp grippingly and rigidly connecting the top edge of the upper portion to the pivot arm; and a pivot bracket connected to the pivot arm, the bracket being mountable to the underside of the roof adjacent an upper comer of the windshield and configured to rotate the shield about the pivot arm axis to a stored position adjacent the underside of the roof and to a deployed position, the bracket further configured for swinging the arm with attached shield to a position between a side window and the occupant.

3. The shield of claim 2, wherein at least one of the portions is encased in a shell of material.

4. The shield of claim 2, wherein at least the one portion that including a window is encased in a shell of material and said shell providing opposing aligned apertures to provide unobstructed viewing through the window.

5. The shield of claim 2, wherein a window is provided in the lower portion and the upper portion, the windows being aligned when the shield is in the closed position for unrestricted viewing therethrough.

6. The shield of claim 2, wherein the window is press fit into the at least one plate of the at least one portion.

7. The shield of claim 2, wherein the window is wedged into the at least one plate of the at least one portion.

8. The shield of claim 2, wherein the window is secured to the at least one plate by fastened to the plate.

9. The shield of claim 2, wherein the window includes a flange, the window being secured to the at least one plate by fasteners through the flange into the plate.

* * * * *